United States Patent [19]

Love

[11] 4,134,171

[45] Jan. 16, 1979

[54] SEPARABLE PAINT BRUSH AND HOLDER ASSEMBLY

[76] Inventor: Francis L. Love, 7010 Reynoldsburg-New Albany Rd., New Albany, Ohio 43054

[21] Appl. No.: 852,151

[22] Filed: Nov. 16, 1977

[51] Int. Cl.[2] ..... A46B 17/02

[52] U.S. Cl. ..... 15/146; 15/145; 15/202; 206/362

[58] Field of Search ..... 15/145, 146, 166, 176, 15/202, 106, 246, 248R; 206/362

[56] References Cited

U.S. PATENT DOCUMENTS

| | | | |
|---|---|---|---|
| 467,046 | 1/1892 | Myers | 15/146 |
| 1,599,273 | 9/1926 | Benkosky et al. | 15/146 |
| 3,205,524 | 9/1965 | Stormyr | 206/362 X |

FOREIGN PATENT DOCUMENTS

| | | | |
|---|---|---|---|
| 601733 | 8/1934 | Fed. Rep. of Germany | 15/146 |
| 404663 | 1/1934 | United Kingdom | 15/166 |

*Primary Examiner*—Peter Feldman
*Attorney, Agent, or Firm*—William S. Rambo

[57] ABSTRACT

A paint brush assembly includes a pair of complete, handle-equipped brushes frictionally, but removably held in side-by-side relationship by a tubular holder to provide a unitary, relatively wider bristle brush assembly. The wider brush assembly may be easily separated or disassembled to provide two independently operable paint brushes of relatively narrow widths.

2 Claims, 5 Drawing Figures

SEPARABLE PAINT BRUSH AND HOLDER ASSEMBLY

BACKGROUND OF THE INVENTION

This invention is directed to a paint brush assembly which includes a handle connector or holder adapted to secure two separately utilizable paint brushes in combined relationship to form a paint brush having the combined effective width of the two brushes.

Brushes primarily designed for painting normally include a set of bristles secured by a metal ferrule or band to a handle. In a conventional paint brush, the set of bristles and ferrule are of a predetermined width often substantially greater than the thickness of the set of bristles. The handle, which is preferably formed from wood, but may be fabricated from a plastic material, is secured in the ferrule and generally includes a section which tapers centrally from each side terminating in a relatively narrow elongated hand grip portion that extends outwardly from the ferrule along a longitudinal central axis of the brush.

It is the usual practice to utilize several brushes of different widths to best perform painting operations on different surface areas and various surface configurations. During the course of a painting operation, it is often necessary to utilize more than one side of brush, and for convenience, it is generally desirable to employ at least two different width brushes to save time and effort in applying paint to a structure having various surface configurations. For example, nonplanar structures, such as moldings, are best painted with a relatively narrow width brush, whereas large planar surfaces are more conveniently and expeditiously painted with a relatively wide brush.

From the standpoint of economy, it has been found that a brush which is twice the width of a given width of brush will cost more than twice that of the given width brush. Accordingly, a person engaged in the painting trade must make a substantial investment to purchase all of the different widths of paint brushes which are normally desired for painting various different types and sizes of sufaces.

SUMMARY OF THE INVENTION

This invention provides a plural paint brush and holder assembly, wherein a pair of paint brushes of comparatively narrow width may either be positioned and frictionally held in coplanar, side-by-side relationship to form a single, relatively wide bristle brush, or separated to provide two independently operable, relatively narrower width brushes. The positioning and securing of the two narrow brushes in side-by-side relationship is achieved by a unique funnel-shaped holder which functions to wedge the brushes therein and to provide a convenient handle for the combined brushes. The holder is easily removable or disengageable from the two brushes to permit them to be separated and independently utilized in accordance with their respective design and size capabilities.

Each of the pair of brushes is provided with a handle that extends from and is secured by a ferrule to a set of bristles. The brush handles are preferably configured to have a narrow, elongated portion disposed in laterally offset relationship to a longitudinal center line passing through the set of bristles. Specifically, each of the narrow handle portions is offset to align with a longitudinal side edge of the bristle set. Also, the narrow handle portions are formed with opposed, longitudinally extending edge surfaces which are relatively convergent in a direction toward the outer or butt end of the handles. In the preferred form, each handle has one edge surface thereof angled toward the longitudinal axis of the handle while the opposite edge surface is parallel to that axis, so that the handle tapers toward the butt end thereof.

Interconnection of the two brushes, which may have bristles sets of the same or different widths, to form a composite brush of the combined bristle widths, is accomplished by a holder or handle connector that is of flattened funnel-shaped configuration and relatively elongated having a longitudinally extending, tapered socket for cooperatively receiving the tapered handles of the two brushes. The interior walls of the socket are configured to cooperatively and frictionally engage with the outer surfaces of the brush handles to effect a wedging action, and thereby detachably securing the handles in the connector. A preferred form of holder or handle connector may be formed from a molded plastic material, and provides a convenient and comfortable handle for the combined brushes. The holder may be readily removed whenever it is desired to separate the two brushes for independent utilization.

The primary object of this invention is to provide an economical paint brush and holder assembly which may be easily converted from a single, relatively wide bristle brush into a pair of separate, handle-equipped, narrow bristle paint brushes.

These and other objects of this invention will be readily apparent from the following detailed description of an illustrative embodiment thereof and the accompanying drawings.

DESCRIPTION OF PREFERRED EMBODIMENT

Figure 1:
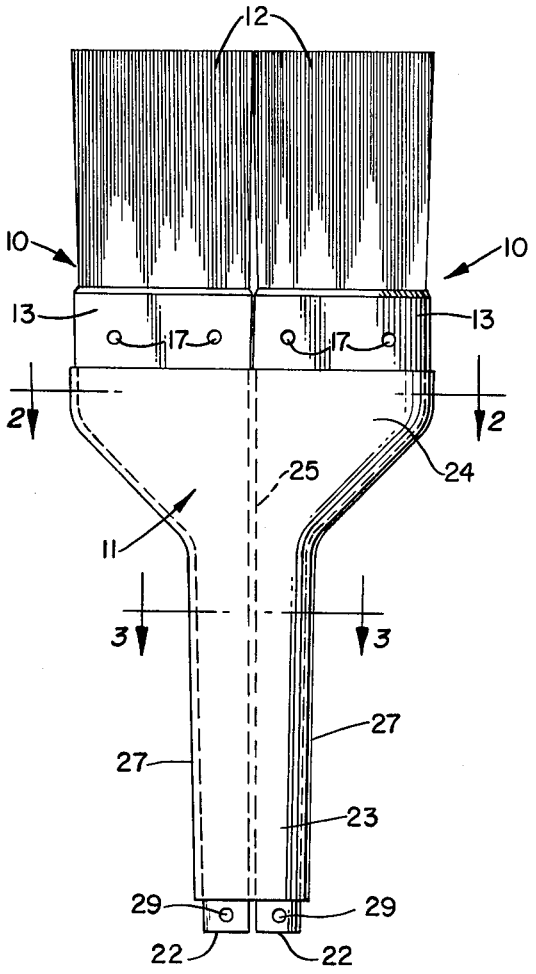
FIG. 1 is an elevational view of a brush and holder assembly embodying this invention.

Having reference to the drawings and specifically to FIG. 1, an embodiment of this invention is illustrated that includes a pair of brushes 10 which are disposed in coplanar side-by-side relationship and interconnected by a handle connector or holder 11. Each of the two brushes 10 is illustrated in this embodiment as being of identical configuration and size, although positioned in relatively oppositely oriented positions. When thus positioned and assembled with the handle connector 11, the two brushes form a composite structure having a width substantially equal to that of the two brushes. Accordingly, it will be seen that the composite assembly results in a brush of generally conventional configuration having a unitary handle portion which tapers toward the butt end thereof. While the brushes 10 are shown as being identical, it will be understood that the widths of the two brushes may be different as deemed appropriate for a specific utilization.

Figure 4:
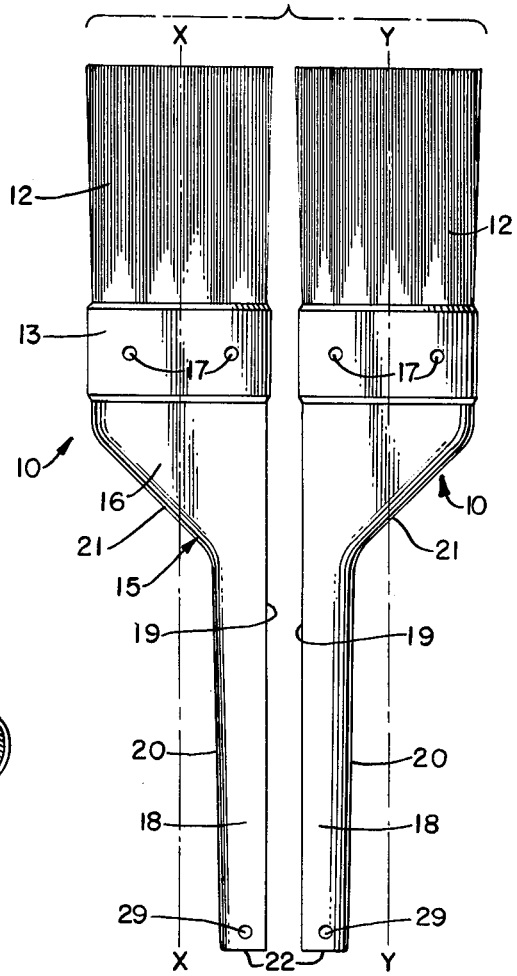
FIG. 4 is an elevational view of the two brush elements of the structure of FIG. 1 with the holder or handle connector removed therefrom.
Figure 5:
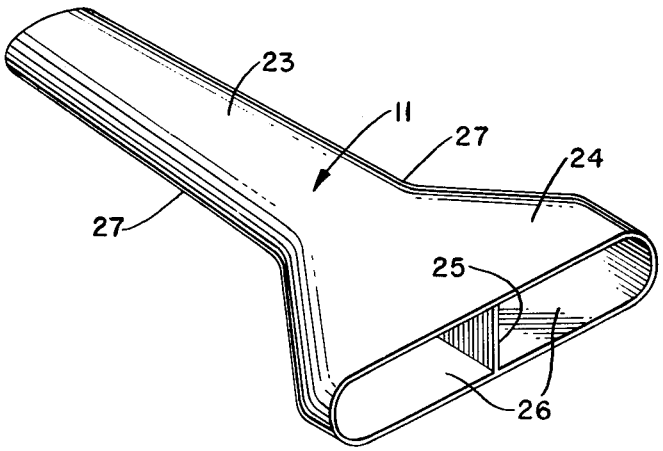
FIG. 5 is a perspective view of the holder.

Each of the two brushes 10 is separately shown in FIG. 4 although adjacently disposed in coplanar, side-by-side relationship as oriented for assembly with the holder or handle connector. Each brush 10 includes a bristle set 12 which, in the illustrative embodiment, has a generally rectangular cross-section with a width that is substantially greater than its thickness. Securing the bristle set 12 in retained relationship is a metal clamping band or ferrule 13 which encircles the base end portion of the respective bristle set. This ferrule, as in a conventional brush construction, may be formed from sheet metal band of suitable thickness that is suitably bent and crimped to tightly clamp the bristle set therein.

Also included in each brush 10 is an elongated handle 15 having an inner connecting end portion 16 which is telescoped and firmly secured in the ferrule 13 as by rivets or other suitable fastening elements 17 which extend through the ferrule and the end portion 16 of the handle 15.

In accordance with this invention, each handle 15 includes an elongated longitudinally extending hand grip portion 18 which is of a relatively narrow width as compared to the connecting end portion 16. As previously indicated, the relatively narrow hand grip portions 18 are disposed in laterally offset relationship to the longitudinal central axes X—X and Y—Y of the brushes as can be best seen in FIG. 4. The hand grip portions 18 are formed with a straight longitudinally extending edge surface 19 thereof disposed in parallel relation to the central axis of the brush and in substantial alignment with a side edge of the bristle set. The opposite longitudinally extending edge surface 20 of the hand grip 18 is slightly tapered or angled toward the butt end 22 thereof in relatively convergent relation to the edge 19. This relative convergence of the opposite edges of the hand grip portions 18 is preferred to facilitate and assure wedging engagement thereof in a socket of the holder or handle connector 11 as will be subsequently explained.

Figure 2:
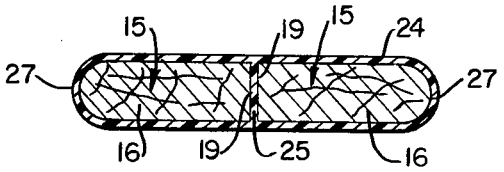
FIG. 2 is a transverse sectional view taken along line 2—2 of FIG. 1.
Figure 3:
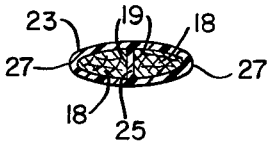
FIG. 3 is a transverse sectional view taken along line 3—3 of FIG. 1.

As indicated in FIGS. 2 and 3, the inner connecting end portions 16 of the handles are relatively thicker than the hand grip portions 18. Preferably, the handles 15 are progressively tapered in their thickness dimensions from the connecting end portions 16 thereof toward the outer or butt ends 22 of the hand grip portions 18. The outwardly facing edge surfaces 21 of the connecting end portions 16 are comparatively sharply tapered, so as to blend the wider connecting end portions 16 into the narrower hand grip portions 18 of the handles. The outer edge surfaces 20 and 21 of the handles are preferably beveled or rounded for gripping comfort.

The handle connector or holder 11 is designed to connect and unitize the two brush units 10, as illustrated in FIG. 1. The holder 11 consists of an integral, thin-walled, generally flattened funnel-shaped shell formed with an elongated, tubular handle section 23, and a relatively wider, outwardly flaring mouth section 24. The holder is preferably open at both ends thereof, and defines an internal chamber or socket conforming in size and shape to the handles 15 of the two brushes when they are disposed in side-by-side relationship. The holder is preferably constructed (molded) from a lightweight plastic or synthetic resin, such as polypropylene, and may include a central, relatively thin, longitudinally extending reinforcing wall or web 25 which divides the internal chamber into a pair of open-ended compartments 26, each conforming in size and shape to the handle 15 of one of the brushes 10.

Preferably, the side walls 27 of the holder, particularly in the elongated handle section 23 thereof, are tapered at slightly steeper angles, say 1° to 2°, than the outer edges 20 of the hand grip portions 18 of the brush handles. This slight differential in taper insures tight frictional, or wedging engagement of the brush handles with the inner walls of the holder when the brush handles are forcibly inserted into the compartments 26.

As shown in FIG. 1, the handles 15 of the brushes 10 are preferably longer than the holder 11, so that the butt ends of the handles may project slightly outwardly beyond the small end of the holder when the brush handles are firmly seated and frictionally held in the socket of the holder. This provides access to the usual hanger holes 29 formed in the butt ends of the handles 15 and also enables the brushes to be quickly and easily separated from the holder by striking the exposed butt ends of the handles sharply against a stationary object while grasping the holder.

Assembly of the two brushes 10 within the holder 11 is readily accomplished by forcibly inserting the two brush handles 15 into the respective sockets 26 to positions at which the tapered edges 20 of the handles are tightly wedged in frictional engagement with the cooperatively tapered inner side walls of the holder. Subsequent removal of the brush elements is readily accomplished by merely striking the butt ends of the handles 15 sharply against a stationary object or surface while gripping the holder. The momentum forces thus developed will break the wedge lock between the brush handles and the holder and release the brushes 10 for subsequent cleaning or independent usage.

It will thus be apparent that the present invention provides a highly useful and efficient means for detachably connecting two, relatively narrow paint brushes to form a single, wider paint brush, while maintaining the brushes intact for separation and individual usage.

While a single, preferred embodiment of the invention has been illustrated and described in detail, it will be understood that various modifications as to design and details of construction are possible without departing from the spirit of the invention or the scope of the following claims.

Having thus described this invention, what is claimed is:

1. In combination with a pair of paint brushes each of which includes a set of bristles at one end and a handle at the opposite end thereof; that improvement which comprises a holder for detachably holding said pair of paint brushes in bristle-adjoining, side-by-side coplanar relationship, said holder consisting of a unitary, hollow body of generally flattened funnel shape, said body being formed with an internal chamber open at its opposite ends and conforming generally to the aggregate size and shape of the handles of said pair of brushes when disposed in side-by-side relationship, the internal chamber of said body being defined at least in part by tapered wall surfaces, and said holder being operable to receive and frictionally hold the handles of said pair of brushes in positions in which the bristles of said brushes are disposed in adjoining, side-by-side substantially coplanar relationship.

2. The combination defined in claim 1, wherein the length of the internal chamber of said body is shorter than the handles of said pair of brushes to permit the outer ends of said handles to project outwardly beyond the holder when said pair of brushes are positioned in the chamber of said body.

* * * * *